United States Patent [19]

Lay et al.

[11] Patent Number: 4,915,268

[45] Date of Patent: Apr. 10, 1990

[54] CLOSURE WITH DISPENSING APPLICATOR

[75] Inventors: Dieter F. Lay, Hawthorn Woods, Ill.; Michael H. Lombardi, Stamford, Conn.

[73] Assignees: Pittway Corporation, Crystal Lake, Ill.; Chesebrough-Pond's Inc., Greenwich, Conn.

[21] Appl. No.: 266,374

[22] Filed: Nov. 2, 1988

[51] Int. Cl.[4] ..... B67D 3/00

[52] U.S. Cl. ..... 222/498; 220/335; 220/339; 222/556; 401/262

[58] Field of Search ..... 222/556, 517, 498, 558, 222/512, 544, 545, 546; 215/235; 220/335, 339; 401/262

[56] References Cited

U.S. PATENT DOCUMENTS

| | | | |
|---|---|---|---|
| 1,137,086 | 4/1915 | Rodiger | 401/262 |
| 1,303,531 | 5/1919 | Albig . | |
| 1,977,302 | 10/1934 | Brill | 222/558 X |
| 2,008,636 | 7/1935 | Brynan | 401/262 |
| 2,096,802 | 10/1937 | Griner | 222/498 |
| 2,197,579 | 4/1940 | Hooper | 401/262 |
| 2,591,207 | 4/1952 | Sepesy | 222/558 |
| 3,369,720 | 2/1968 | Libit et al. | 222/517 |
| 3,659,750 | 5/1972 | La Vange | 222/536 |
| 3,741,447 | 6/1973 | Miles et al. | 222/498 X |
| 3,896,978 | 7/1975 | Sahar | 222/517 |
| 3,933,271 | 1/1976 | McGhie | 222/498 X |
| 4,087,028 | 5/1978 | Lang | 222/556 |
| 4,158,902 | 6/1979 | Chernack et al. | 222/498 X |
| 4,377,247 | 3/1983 | Hazard et al. | 222/517 |
| 4,386,714 | 6/1983 | Roberto et al. | 222/517 X |
| 4,403,712 | 9/1983 | Wiesinger | 220/339 |
| 4,778,071 | 10/1988 | Fillmore | 222/498 X |

OTHER PUBLICATIONS

Photograph A, Vaseline Lip Therapy Tube with Threaded Closure.

Photograph B, Vaseline Lip Therapy Tube with Threaded Closure Removed.

Photograph C. Chap Stick Tube with Threaded Closure (side elevation).

Photograph D, Chap Stick Tube with Threaded Closure (top view).

Photograph E, Chap Stick Tube with Threaded Closure Removed.

Photograph F, Chap Stick Tube of Another Color with Threaded Closure Removed to Show Closure Interior.

Photograph G, Blistex Tube with Threaded Closure (side elevation).

Photograph H, Blistex Tube with Threaded Closure (top view).

Photograph I, Blistex Tube with Threaded Closure Removed.

Photograph J, Blistex Tube with Threaded Closure Removed to Show Closure Interior.

*Primary Examiner*—Kevin P. Shaver

*Attorney, Agent, or Firm*—Dressler, Goldsmith, Shore, Sutker & Milnamow, Ltd.

[57] ABSTRACT

A container closure is provided with a body defining a dispensing orifice and a cover disposed on the body for being pivoted between a closed position occluding the orifice and an open position spaced away from the orifice. A hinge connects the cover to the body. The body has a generally smooth applicator surface around the dispensing orifice. The cover has an inwardly projecting sealing protrusion for entering at least partially into the dispensing orifice and sealingly engaging the body at the periphery of the dispensing orifice when the cover is in the closed position. The body and the cover together cooperate to define latching means, such as (1) an engagement between the protrusion and a portion of the body around at least part of the periphery of the orifice or (2) engaging ribs on the body and cover for releasably holding the cover in the closed position.

11 Claims, 4 Drawing Sheets

CLOSURE WITH DISPENSING APPLICATOR

TECHNICAL FIELD

This invention relates to closures for containers, and more particularly to a closure which incorporates means for facilitating application of the container contents to a receiving surface, including the surface of the human body.

BACKGROUND OF THE INVENTION AND TECHNICAL PROBLEMS POSED BY THE PRIOR ART

Container closures having separate, removable covers have long been used. However, separate covers can be accidentally dropped or lost.

Further, use of a separate, removable cover is inconvenient in many situations. Containers for personal care products, such as lotions and the like, are frequently carried by people in pockets or purses. When it is desired to dispense the container contents, the person may not be able to conveniently use both hands in manipulating the container, and the person may find it difficult to properly dispense the container contents with one hand while holding the removed cover in the other hand.

Accordingly, it would be desirable to provide a means for mounting a container with a closure having a connected cover which would permit use of the container without the inconvenience of having to remove and hold a separate cover.

Containers for fluid materials are typically used by pouring or dispensing the fluid material from the container after it has been opened. Some containers, however, are used in a particular way to facilitate the application of the fluid to a particular surface, including a surface of the human body, such as the skin on various areas of the body. Regardless of whether or not the cover of a closure on such a container is separately removable, it would be desirable to provide an improved structure for facilitating the application of the container fluid contents to the receiving surface. It would also be desirable to provide a suitble structure on a closure for maintaining a supply of the fluid contents in an appropriate manner for application, with relative ease.

In addition, with a container closure from which a fluid material is dispensed, it would be desirable to ensure that the closure is leak tight when the cover is closed. Accordingly, it would be advantageous to provide a closure with a dispensing applicator having an improved sealing structure.

SUMMARY OF THE INVENTION

A container closure for use on a container defining an opening communicating with the container interior is provided with a body for being mounted to the container over the container opening. The body defines a dispensing orifice for cummunicating through the container opening with the container interior. The body has a generally smooth applicator surface around the dispensing orifice.

The closure includes a cover disposed on the body for being pivoted about an axis between a closed position occluding the dispensing orifice and an open position spaced away from the dispensing orifice.

A hinge is provided for connecting the cover to the body for pivoting movement about the axis.

The body and the cover define cooperating latching means for releasably holding the cover in the closed position.

The cover has an inwardly projecting sealing protrusion for entering at least partially into the dispensing orifice and sealing engaging the body at the periphery of the dispensing orifice when the cover is in the closed position. In a preferred embodiment, the peripheral surface of the orifice and the protrusion are adapted to provide a leak-tight, interference fit, and the body and cover are resiliently deformable to function as the latching means.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

Figure 2:
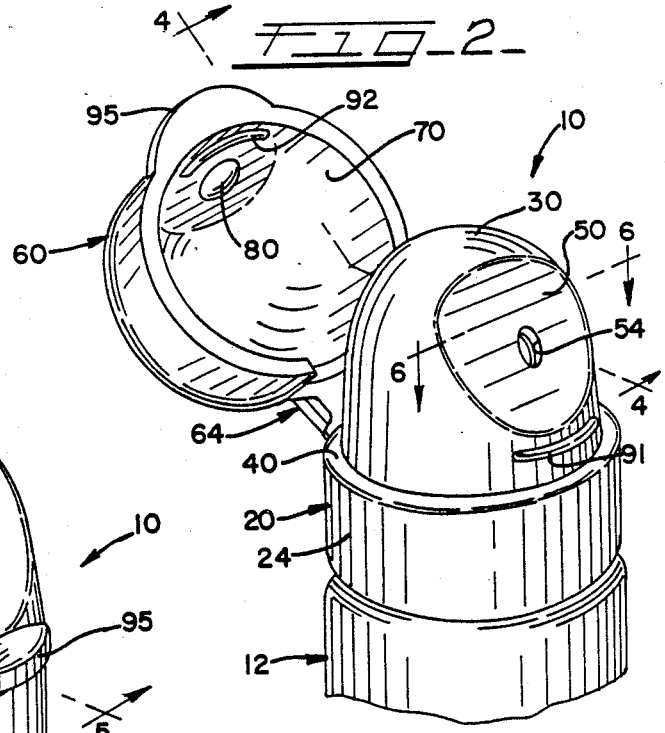
FIG. 2 is a fragmentary, perspective view similar to FIG. 1 showing the cover in an open position.

While this inventin is susceptible of embodiment in many different forms, this application and the accompanying drawings disclose only some specific forms as examples of the invention. The invention is not intended to be limited to the embodiments so described, and the scope of the invention will be pointed out in the appended claims.

For ease of description, the closure of the invention is described in a position as it is usually encountered—upright on a container, and terms such as upper, lower, vertical, horizontal, etc., are used with reference to this position. It will be understood, however, that the closure of this invention may be manufactured, stored, transported, and used in an orientation other than the position described.

The first embodiment of the closure of the present invention is illustrated in FIGS. 1–8 wherein the closure is represented generally by the reference numeral 10. The closure 10 is adapted to be disposed on a container 12 which has a conventional mouth or opening 14 (FIGS. 4 and 5) defined by a neck 16 or other suitable structure. The closure may be fabricated from a thermoplastic material compatible with the container contents.

Figure 4:
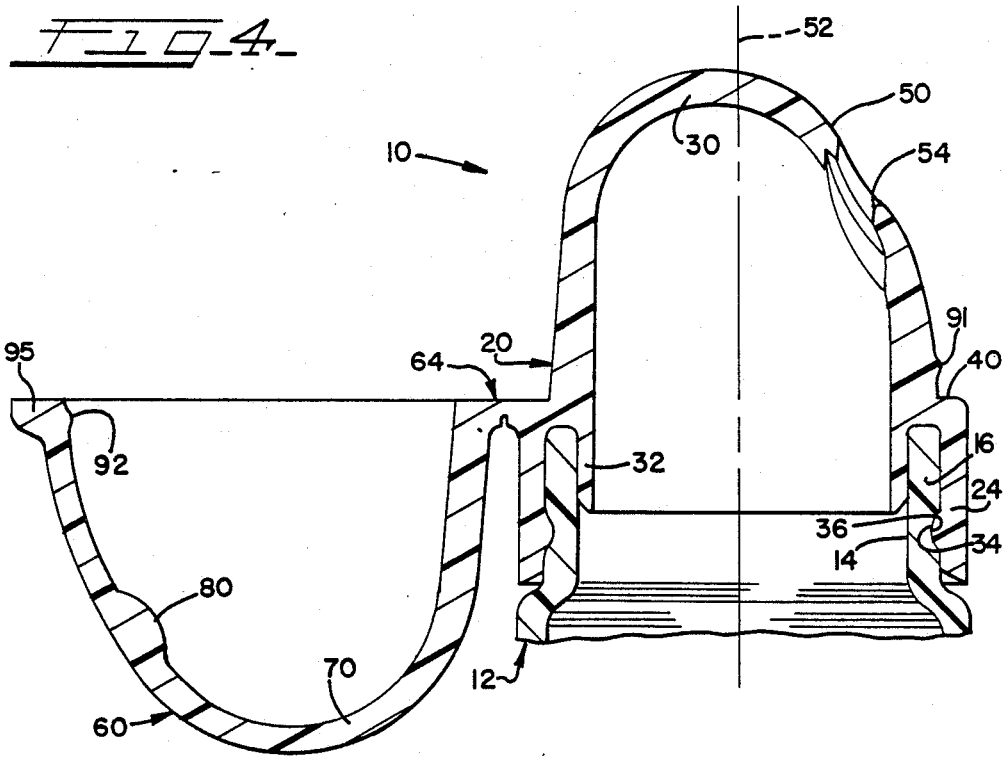
FIG. 4 is an enlarged, fragmentary, cross-sectional view taken generally along the plane 4—4 in FIG. 2.
Figure 5:
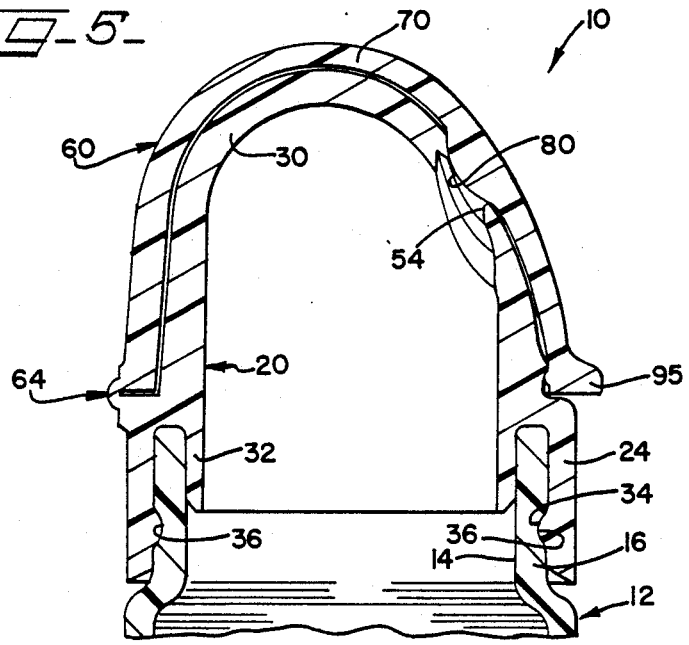
FIG. 5 is a fragmentary, cross-sectional view similar to FIG. 4 but showing the closure with the cover in the latched closed position.
Figure 6:
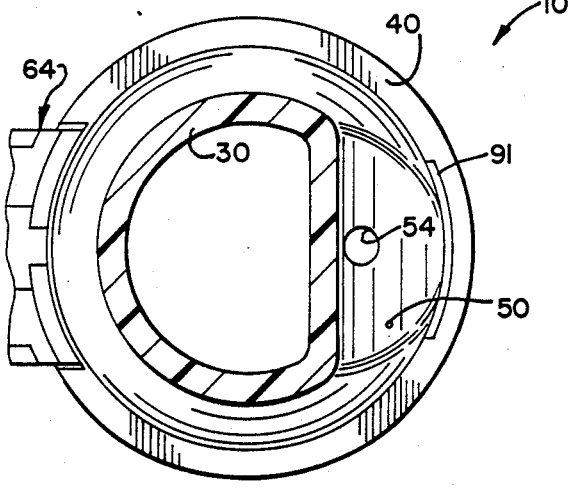
FIG. 6 is a fragmentary, cross-sectional view taken generally along the plane 6—6 of FIG. 2.

As best illustrated in FIGS. 4 and 5, the closure 10 includes a closure means or body 20 for securement to the container. In the illustrated embodiment, the body 20 includes a peripheral wall in the form of a skirt 24 formed as a cylinder around an axis 52 (FIG. 4) and a generally dome-shaped portion 30 projecting from the skirt 24.

As best illustrated in FIGS. 4 and 5, the closure body 20 also includes an internal ring 32 which functions as a plug seal and protrudes into the interior of the container neck 16 for engaging the inner peripheral surface of the neck 16 to effect a tight seal.

As best illustrated in FIGS. 4 and 5, the closure body 24 includes, on its interior surface, a standard snap-fit bead 34 or other suitable means (e.g., threads (not illustrated) for engaging suitable cooperating means, such as the recess 36, on the container neck 16 to releasably secure the body 20 on the container 12.

Figure 3:
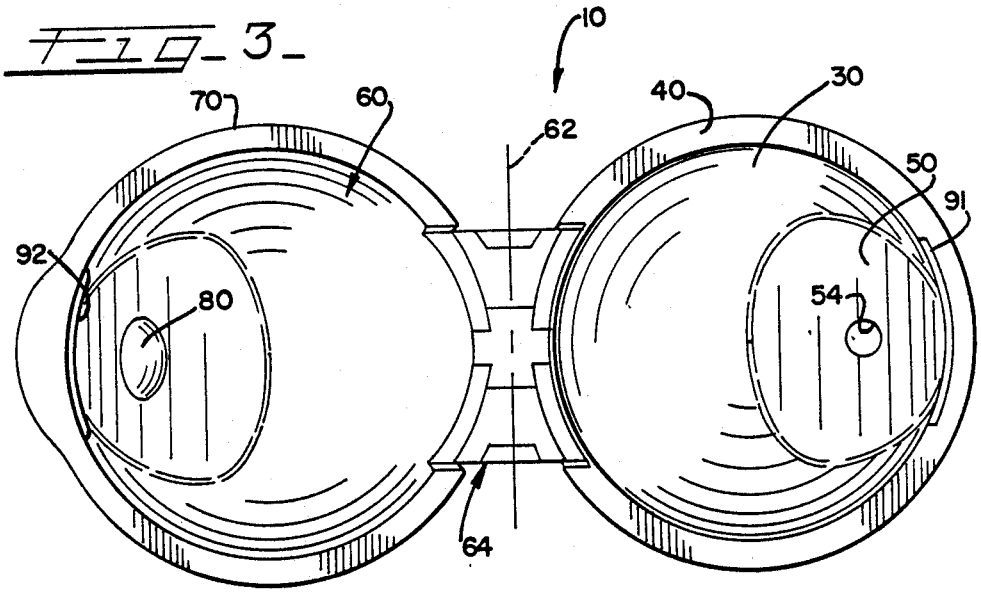
FIG. 3 is an enlarged, plan view of the first embodiment of the opened closure.

In the preferred embodiment illustrated, the closure body 20 includes a peripheral deck 40 (FIGS. 2–4). The peripheral edge of the deck 40 is preferably rounded to prevent user discomfort. The dome-shaped portion 30 projects upwardly from the deck 40 and includes a generally smooth, less curved exterior region 50 (FIGS. 2–4) which is oriented at an oblique angle to the vertical axis 52 (FIG. 4) of the closure skirt 24.

The less curved exterior region 50 defines an applicator surface around a dispensing orifice 54. The dispensing orifice 54 is located in the region 50 below the top of the dome-shaped portion 30. The orifice 54 is a generally cylindrical bore oriented parallel to the vertical axis 52. This shape and orientation of the dispensing orifice 54 is preferred to facilitate manufacturing and to facilitate the dispensing of the fluid product upwardly onto the product applicator surface of the region 50.

The closure 10 includes a lid or cover 60 which is disposed on the body 20 for being pivoted about an axis 62 (FIG. 3) between a closed position (FIGS. 1 and 5) and an open position (FIGS. 2 and 4). A hinge 64 connects the cover 60 to the body 20 as best illustrated in FIGS. 2 and 3. The hinge 64 is at a location about 180° around the body vertical axis 52 from the applicator surface region 50.

Preferably, the hinge 64 is a snap-action hinge formed integrally with the cover 60 and body 20 in a unitary structure. The illustrated snap-action hinge 64 is a conventional type described in U.S. Pat. No. 4,403,712. Other hinge structures may be employed, including a "floppy" living film hinge. However, it is preferable to employ a snap-action hinge so as to be able to maintain the cover 60 in the open position during an application of the container contents to the applicating site.

Figure 1:
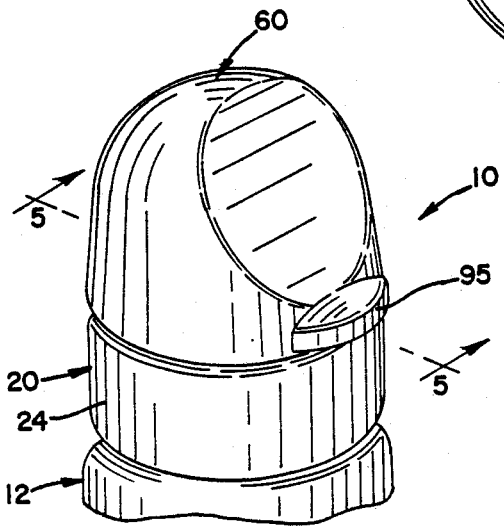
FIG. 1 is a fragmentary, perspective view of a first embodiment of the closure of the present invention mounted on a container and shown with the cover latched in the fully closed position.
Figure 7:
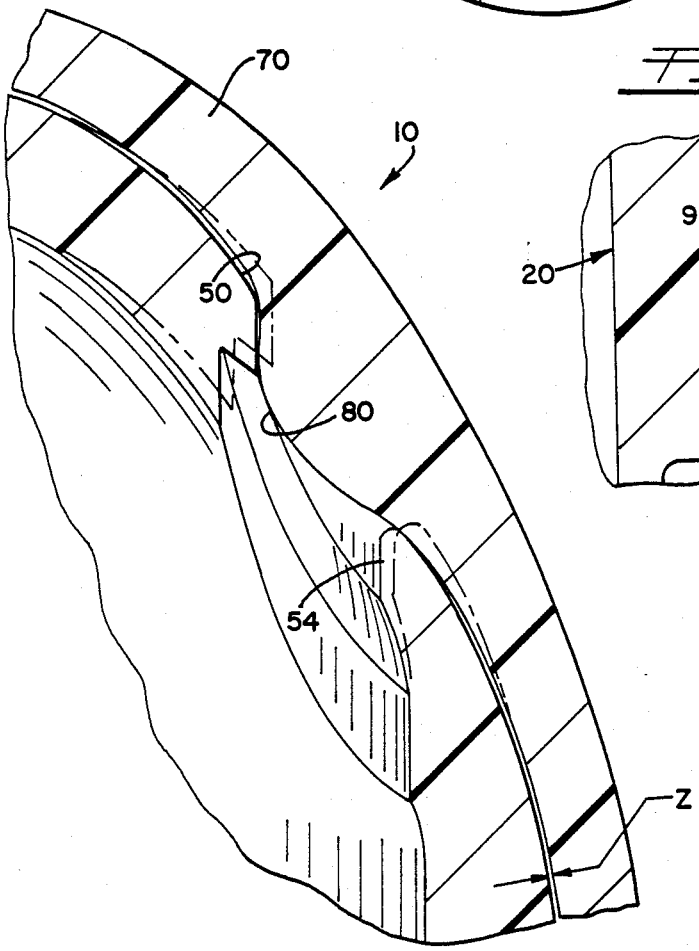
FIG. 7 is a greatly enlarged, fragmentary, cross-sectional view of a portion of the first embodiment of the closure showing the dispensing orifice and the occluding portion of the cover in the closed position.

The closure 60 includes a generally dome-shaped wall 70 with an inner concave configuration that is complementary to the body dome-shaped portion 30 for nestably covering the dome-shaped portion 30 when the cover 60 is in the closed position. The cover wall 70 has an inwardly projecting sealing protrusion 80 for entering at least partially into the dispensing orifice 54 and sealingly engaging the region 50 at the periphery of the dispensing orifice 54 when the cover 60 is in the closed position (FIGS. 1, 5 and 7). The sealing protrusion 80, in the embodiment illustrated, has a partially spherical configuration.

As best illustrated in FIG. 5, the closure 10 is preferably fabricated so that, when the cover is in the closed position, there is a clearance between the body dome-shaped portion 30 and the cover 60, except around the orifice 54 in the less curved exterior region 50. In one preferred embodiment, the clearance is about 0.010 inch as designated by reference numeral Z in FIG. 7.

The dome-shaped portion 30 is preferably elastically deformable, at least in the less curved exterior region 50, and the sealing protrusion 80 preferably projects inwardly an amount sufficient to deflect the region 50 inwardly when the cover 60 is closed to thereby effect a biasing of the periphery of the dispensing orifice 54 against the sealing protrusion 80. The sealing protrusion 80 causes the region 50 to deflect inwardly from the undeflected position (illustrated in dashed lines in FIG. 7) to a deflected position (illustrated in solid lines in FIG. 7) to thereby effect a tight seal at the orifice 54 to prevent leakage.

The closure 60 is preferably latched closed so as to maintain the sealing protrusion 80 against the inwardly deflected region 50. To this end, the body 20 and cover 60 define cooperating latching means for releasably holding the cover 60 in the closed position, and the latching means include a first snap-fit latching rib 91 (FIG. 8) on the body 20 opposite the hinge 64 and a second snap-fit latching rib 92 on the cover 60 opposite the hinge 64. The ribs 91 and 92 engage in a snap-fit interlock when the cover 60 is in the closed position as illustrated in FIGS. 5 and 8.

Figure 8:
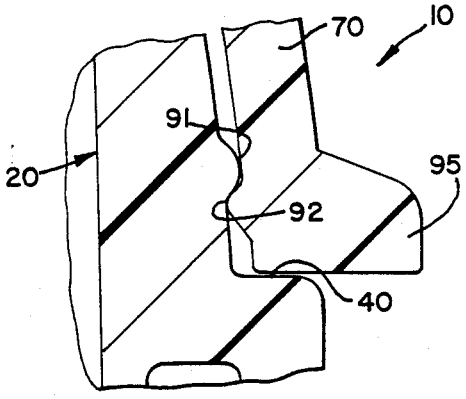
FIG. 8 is a greatly enlarged, fragmentary, cross-sectional view of the first embodiment of the closure showing the structure for latching the cover in the closed position.

As best illustrated in FIG. 8, the first snap-fit rib 91 on the body 20 and the second snap-fit rib 92 on the cover 60 each define a circular arc cross-section configuration in a plane parallel to the vertical axis of the closure.

To aid in opening the closure, the cover 60 is provided with a thumb-engageable opening tab 95 opposite the hinge 64 as best illustrated in FIGS. 1, 2, and 8.

The closure 10, in the preferred embodiment illustrated, is particularly suitable for use on a container 12 from which a fluid substance is to be dispensed onto a human body part, especially the lips. The container 12 may be flexible so that the fluid can be squeezed from the container through the dispensing orifice 54 onto the applicator surface of the region 50. The orientation of the surface 50 facilitates applying the fluid to the lips. The snap-action hinge 64 maintains the cover 60 in an open position which does not interfere with the applicating site, and the hinge 64 also keeps the cover 60 attached to the closure and container.

Figure 9:
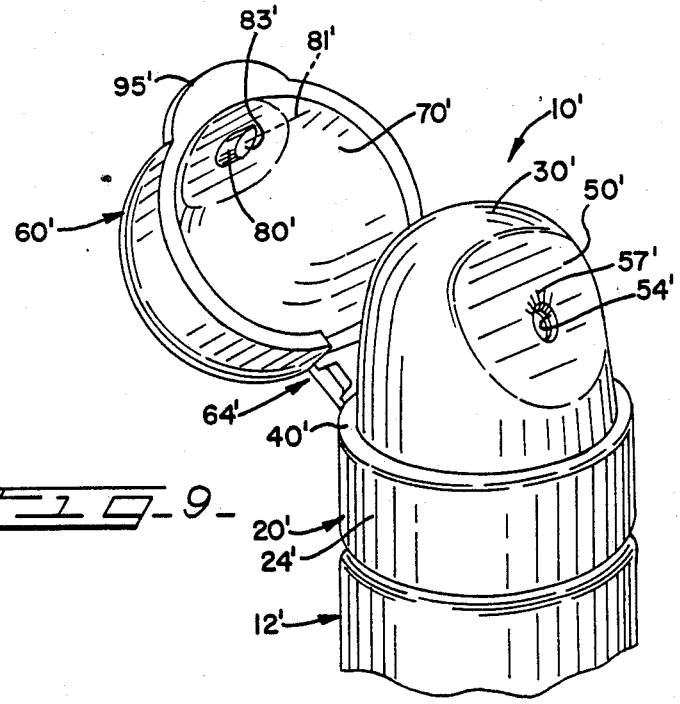
FIG. 9 is a view similar to FIG. 2 but shows a second, and preferred, embodiment of the closure of the present invention.
Figure 10:
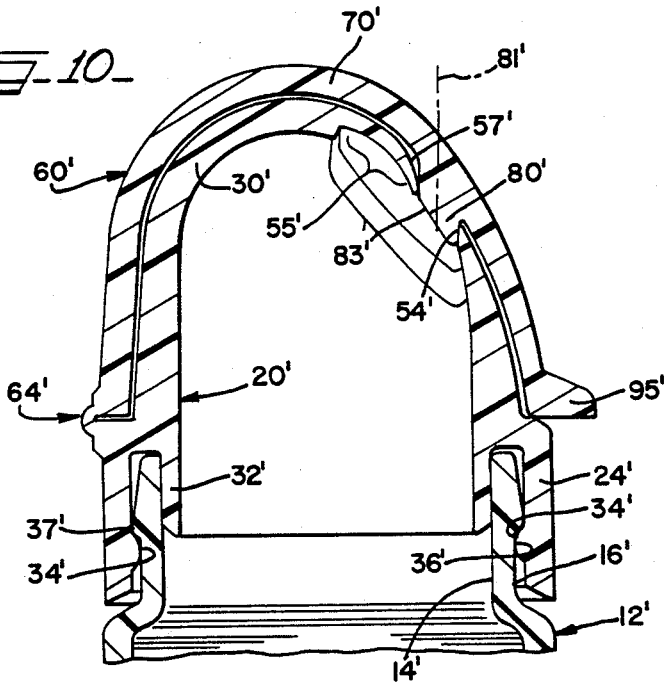
FIG. 10 is a view similar to FIG. 5 but shows the second embodiment of the closure.

A second embodiment of the closure of the present invention is illustrated in FIGS. 9 and 10 and is designated generally therein by reference numeral 10'. The closure 10' is similar to, and functions in many respects in a manner similar to, the first embodiment of the closure 10 described above with reference to FIGS. 1–8. The elements of the second embodiment of the closure 10' that are identical or functionally analgous to those of the first embodiment of the closure 10 are designated by reference numerals identical to those used for the first embodiment with the exception that the second embodiment reference numerals are followed by a prime mark whereas the first embodiment reference numerals are not followed by a prime mark.

The second embodiment of the closure 10' differs from the first embodiment in a number of respects. First, the second embodiment cover 60' is retained on the container 12' by means of the standard snap-fit bead 34' which engages a snap-fit bead 37' on the container above a wall portion 36' (as best viewed on the left-hand side of FIG. 10).

Further, in the second embodiment, the process of opening of the closure is facilitated by providing a larger (i.e., longer) thumb-engageable opening tab 95'.

The second embodiment of the closure 10' also differs from the first embodiment with respect to the first embodiment latching means ribs 91 and 92 and the sealing protrusion 80. In particular, the second embodiment of the closure 10' does not include any latching ribs on the body 20' and cover 60', and the second embodiment has a differently shaped sealing protrusion 80' for entering into the dispensing orifice 54' in the body 20'.

Preferably, the dispensing orifice 54' is a bore defined in the body 20' by a generally cylindrical peripheral surface, and the sealing protrusion 80' may be characterized as a plug member with a generally cylindrical side wall having a diameter greater than the diameter of the bore of the orifice 54'. As best illustrated in FIGS. 9 and 10, the cylindrical side wall of the protrusion or plug member 80' is oriented about a longitudinal axis 81'. The distal end of the protrusion or plug member 80' extends through the orifice 54'. The distal end of the protrusion or plug member 80' is defined in part by a generally planar surface 83' which is oriented as an oblique angle to the longitudinal axis 81'. Preferably, as best illustrated in FIG. 10, the peripheral edge of the planar surface 83' of the protrusion or plug member 80' is arcuate to facilitate insertion into the orifice 54'.

The orifice 54' is defined in the region 50' of the closure body 20', and the portion of the region 50' around the upper periphery of the orifice 54' has a reduced thickness as indicated generally by reference numeral 55' (FIG. 10). The reduced thickness portion 55' permits enough flexing of the dome-shaped portion 30' to accommodate insertion and removal of the plug member 80'. Further, to facilitate removal of the plug member 80', an edge part 57' of the portion 55' at the upper periphery of the orifice 54' is even thinner.

The orifice 54', which is defined in the closure body 20' by a cylindrical peripheral surface, has a diameter slightly less than the diameter of the protrusion or plug member 80'. In a preferred embodiment of one proposed commercial form of the second embodiment of the invention illustrated in FIGS. 9 and 10, the diameter of the orifice 54' is about 0.004 inch less than the diameter of the closure plug member 80'. The plug member 80' is adapted to be matingly engaged in an interference fit with the peripheral surface of the orifice 54' to frictionally retain the plug member 80' in the orifice 54' so as to prevent leakage out of the orifice 54' when the cover 60' is in the closed position on the closure body 20'.

In the preferred embodiment of the invention, the oblique planar surface 83' of the protrusion or plug member 80' will engage and slide across the upper exterior applicator surface or region 50' as the cover 60' is moved to the fully closed position (illustrated in FIG. 10). Although there can be some small amount of inward deflection of the region 50' as the protrusion plug member 80' slides over it and into the orifice 54', such deflection may be very small and may only be temporary. In comparison with the region 50 in the first embodiment illustrated in FIG. 7, the deflection of the second embodiment region 50' illustrated in FIG. 10 may be much less (or even non-existent) in the final, fully closed position.

The protrusion or plug member 80' incorporated in the second embodiment of the closure 10' also functions as a clean-out means for cleaning out the container contents residue from inside the orifice 54' by pushing such residue inwardly into the container. In this manner, the likelihood of the orifice 54' becoming occluded with the container contents is reduced.

It is to be noted that the plug member 80' functions as a means for sealing the orifice 54' in addition to cooperating with the wall portion 55' to latch the cover 60' closed. With respect to the latching function, it is to be noted that the reduced thickness portion 55' of the upper peripheral region around the orifice 54' functions as a cooperating or interacting latching means with the plug member 80'. In particular, although the plug member 80' and the orifice 54' may have a snap-fit or interference fit to effect a seal for preventing leakage, such a snap-fit or interference fit is not required to prevent lift-off of the cover 60'. Rather, the structure that latches the cover 60' closed below a minimum design light-off force is the engagement of the reduced thickness portion 55' with the plug member 80'. If a sufficient opening force is applied to the lift tab 95', the plug member 80' moves upwardly in an arc as the cover 60' swings about the hinge 64', and this deforms the wall portion 55' inwardly. In addition, the entire cover 60' may be deformed outwardly a small amount in response to the opposite but equal reaction force at the wall portion 55'. This temporary deformation or resilient characteristic of the structure permits the cover 60' to be unlatched. By the same token, the sufficient stiffness of the cover 60' and wall portion 55' serve to hold the cover 60' in the latched closed unless a lift-off force of sufficient magnitude is applied to the lift tab 95'.

It is to be recalled that the diameter of the orifice 54', in the preferred embodiment, is about 0.004" less than the diameter of the closure plug 80'. This interference fit serves to, and does, function primarily for preventing leakage out of the orifice 54'. However, to some extent, this interference fit will also help hold the cover 60' closed. However, in the preferred embodiment, the additional "latching function" of such an interference fit is relatively insignificant, and indeed is not even required, in comparison to the resilient latching structure provided by the cover 60' and wall portion 55' discussed in detail above.

It will be readily observed from the foregoing detailed description of the invention and from the illustrated embodiment thereof that numerous variations and modifications may be effected without departing from the true spirit and scope of the novel concepts or principles of this invention.

What is claimed is:

1. A container closure for use on a container defining an opening communicating with the container interior, said closure comprising:

a body for being mounted to said container over said container opening and defining a dispensing orifice for communicating through said container opening with said container interior;

a cover disposed on said body for being pivoted about an axis between a closed position occluding said dispensing orifice and an open position spaced away from said dispensing orifice;

a hinge connecting said cover to said body for pivoting movement about said axis;

said body having a generally smooth applicator surface around said dispensing orifice;

said cover having an inwardly projecting sealing protrusion for entering at least partially into said dispensing orifice and sealinging engaging said body at the periphery of said dispensing orifice when said cover is in said closed position;

said body and cover defining cooperating latching means for releasably holding said cover in said closed position;

said dispensing orifice including a bore defined in said body by a generally cylindrical peripheral surface;

said sealing protrusion including a plug member with a generally cylindrical side wall having a diameter greater than the diameter of said bore whereby said plug member is adapted to be matingly engaged with said bore peripheral surface to effect a leak-tight seal when said cover is in said closed position;

said body being thinner around a portion of the periphery of said bore to permit flexing to accommodate insertion of said plug member; and said body being even thinner at the edge of said bore in said peripheral portion to facilitate subsequent removal of said plug member.

2. The container closure in accordance with claim 1 in which said body has a cylindrical skirt for engaging said container and for defining a vertical axis, said body further having a generally dome-shaped portion projecting from said skirt, and said generally dome-shaped portion including a generally smooth, less curved exterior region oriented generally at an oblique angle to said vertical axis for defining said applicator surface around said dispensing orifice.

3. The container closure in accordance with claim 1 in which said cover includes an outwardly projecting, thumb-engagable, opening tab opposite said hinge.

4. The container closure in accordance with claim 1 in which said hinge is a snap-action hinge fabricated from thermoplastic material.

5. The container closure in accordance with claim 1 in which said applicator surface is at a location about 180 degrees around said body vertical axis from said hinge.

6. The container closure in accordance with claim 1 in which said cooperating latching means includes (1) at least a part of said thinner body around a portion of the periphery of said bore and (2) at least a portion of said cover plug member, at least one of said thinner body part and said plug member being resiliently deformable to accommodate the movement of said plug member away from said orifice as said cover is pivoted about said axis.

7. The container closure in accordance with claim 1 in which said cover includes a generally dome-shaped wall with an inner concave configuration complementary to said body dome-shaped portion for nestably covering said body dome-shaped portion when said cover is in said closed position; and in which said plug member cylindrical side wall is oriented about a longitudinal axis and in which said plug member has a distal end for entering through said orifice, said distal end being defined in part by a generally planar surface oriented at an oblique angle to said longitudinal axis.

8. The container closure in accordance with claim 7 in which a peripheral edge of said planar surface is arcuate to facilitate insertion into said orifice.

9. A container closure for use on a container defining an opening communicating with the container interior, said closure comprising:

a body for being mounted to said container over said container opening and defining a dispensing orifice for communicating through said container opening with said container interior;

a cover disposed on said body for being pivoted about an axis between a closed position occluding said dispensing orifice and an open position spaced away from said dispensing orifice;

a hinge connecting said cover to said body for pivoting movement about said axis;

said body having a generally smooth applicator surface around said dispensing orifice;

said cover having an inwardly projecting sealing protrusion for entering at least partially into said dispensing orifice and sealingly engaging said body at the periphery of said dispensing orifice when said cover is in said closed position;

said body and cover defining cooperating latching means for releasably holding said cover in said closed position;

said dispensing orifice including a bore defined in said body by a generally cylindrical peripheral surface;

said sealing protrusion including a plug member with a generally cylindrical side wall having a diameter greater than the diameter of said bore whereby said plug member is adapted to be matingly engaged with said bore peripheral surface to effect a leak-tight seal when said cover is in said closed position;

said body having a cylindrical skirt for engaging said container and for defining a vertical axis;

said body further having a generally dome-shaped portion projecting from said skirt, and said generally dome-shaped portion including a generally smooth, less curved exterior region oriented generally at an oblique angle to said vertical axis for defining said applicator surface around said dispensing orifice;

said cover including a generally dome-shaped wall with an inner concave configuration complementary to said body dome-shaped portion for nestably covering said body dome-shaped portion when said cover is in said closed position; and said plug member cylindrical side wall being oriented about a longitudinal axis and said plug member having a distal end for entering through said orifice, said distal end being defined in part by a generally planar surface oriented at an oblique angle to said longitudinal axis.

10. The container closure in accordance with claim 9 in which a peripheral edge of said planar surface is arcuate to facilitate insertion into said orifice.

11. A container closure for use on a container defining an opening communicating with the container interior , said closure comprising:

a body for being mounted to said container over said container opening and defining a dispensing orifice for communicating through said container opening with said container interior;

a cover disposed on said body for being pivoted about an axis between a closed position occluding said dispensing orifice and an open position spaced away from said dispensing orifice;

a hinge connecting said cover to said body for pivoting movement about said axis;

said body having a generally smooth applicator surface around said dispensing orifice;

said cover having an inwardly projecting sealing protrusion for entering at least partially into said dispensing orifice and sealingly engaging said body at the periphery of said dispensing orifice when said cover is in said closed position, said protrusion having the form of a plug member with a generally cylindrical side wall;

said body and cover defining cooperating latching means for releasably holding said cover in said closed position;

said body including a wall defining said orifice in the form of a bore defined by a generally cylindrical peripheral surface having a diameter smaller than the diameter of said plug member, said cooperating latching means including (1) a portion of said body wall adjacent said dispensing orifice and (2) at least a portion of said cover, said adjacent wall portion having means to permit resilient deformation thereof by said sealing protrusion plug member to accommodate the movement of said sealing protrusion plug member away from said orifice as said cover is pivoted about said axis.

* * * * *